US006974903B2

(12) United States Patent
Saunders

(10) Patent No.: US 6,974,903 B2
(45) Date of Patent: Dec. 13, 2005

(54) KEYBOARD ATTACHMENT FOR DISABLED PERSONS

(76) Inventor: Craig Saunders, 167 Central Ave., North Versailles, PA (US) 15137

( * ) Notice: Subject to any disclaimer, the term of this patent is extended or adjusted under 35 U.S.C. 154(b) by 212 days.

(21) Appl. No.: 10/721,734

(22) Filed: Nov. 25, 2003

(65) Prior Publication Data

US 2005/0109198 A1 May 26, 2005

(51) Int. Cl.[7] ..... G10H 1/32
(52) U.S. Cl. ..... 84/744; 400/472
(58) Field of Search ..... 84/744, 719; 341/21, 341/22; 400/489, 472

(56) References Cited

U.S. PATENT DOCUMENTS

| | | | | |
|---|---|---|---|---|
| 4,513,652 | A | 4/1985 | Muramatsu et al. | |
| 4,729,276 | A | 3/1988 | Cutler | |
| 5,025,785 | A | 6/1991 | Raskin | |
| 5,339,213 | A | 8/1994 | O'Callaghan | |
| 5,493,075 | A | 2/1996 | Chong et al. | |
| D390,211 | S | 2/1998 | Yates et al. | |
| 5,753,840 | A * | 5/1998 | Saboia De Albuquerque | 84/453 |
| 5,856,022 | A | 1/1999 | McCormick | |
| 5,856,822 | A | 1/1999 | Du | |
| 5,909,211 | A | 6/1999 | Combs | |
| 5,956,019 | A | 9/1999 | Bang | |
| 6,060,653 | A | 5/2000 | Willis | |
| 6,107,997 | A | 8/2000 | Ure | |
| 6,226,050 | B1 | 5/2001 | Lee | |
| 6,271,452 | B1 | 8/2001 | Bernard | |
| 6,284,961 | B1 | 9/2001 | Kimmel, Jr. | |
| D449,307 | S | 10/2001 | Amano et al. | |
| 6,323,845 | B1 | 11/2001 | Robbins | |
| 6,329,585 | B1 | 12/2001 | Chono | |
| 6,336,614 | B1 | 1/2002 | Kwitek | |
| 6,388,660 | B1 | 5/2002 | Manser | |
| 6,644,605 | B1 * | 11/2003 | Tyner | 248/118.1 |
| 2002/0050206 | A1 | 5/2002 | MacCutcheon | |
| 2005/0129447 | A1 * | 6/2005 | Benson | 400/472 |

* cited by examiner

*Primary Examiner*—David Martin
*Assistant Examiner*—Jianchun Qin
(74) *Attorney, Agent, or Firm*—The Webb Law Firm

(57) ABSTRACT

A key extender includes an elongated member, e.g., a deformable metal rod having a first end portion secured to a contact member, e.g., a circular disc having a contact area greater than the available touch plate surface area of the key. An opposite second end portion of the elongated member is secured to an attachment member, e.g., a binder clip. Mounting an extender on each of the keys of a device and shaping the metal rod to position the discs adjacent to and spaced from one another allows a disabled person to play a musical instrument or perform a similar function.

19 Claims, 2 Drawing Sheets

KEYBOARD ATTACHMENT FOR DISABLED PERSONS

RELATED DISCLOSURE DOCUMENT

Disclosure Document No. 526012 deposited on Feb. 13, 2003 by Craig Saunders for Keyboard Attachments is related to the subject matter of this application and is hereby incorporated by reference.

BACKGROUND OF THE INVENTION

1. Field of the Invention

This invention relates to an attachment to a key of a keyboard for disabled persons and, more particularly, to attachments for keys of a keyboard to provide a contact area greater than the available touch plate surface area of the keys.

2. Description of Related Art

The keys of keyboards for musical instruments, e.g., pianos and organs and for equipment, e.g., typewriters, calculators, telephones, and computers are closely spaced to one another and systematically arranged to play a musical arrangement or to operate a machine or device, respectively. The keys are closely spaced to facilitate rapid displacement of the fingers of the player or operator over selected keys and systematically depressing the selected keys.

Although the closely spaced keys facilitates contact for the able person, they pose drawbacks for the disabled person, e.g., a person with missing fingers, hand(s), arthritic hands and/or fingers, to name a few limitations. One solution is to enlarge the touch plate surface area of the keys. This solution has drawbacks, e.g., increased cost of making a larger keyboard for a low volume product, and requiring increased floor area to support the musical instrument and increased surface area to support the keyboard for equipment.

As can be appreciated, it would be advantageous to provide an attachment to the keys that eliminates the above drawbacks, e.g., makes the size of the keys of the presently available keyboards of musical instruments and equipment useable by disabled persons.

SUMMARY OF THE INVENTION

This invention relates to an attachment or extender for a key of a keyboard, the key having a predetermined available touch plate surface area. In one non-limiting embodiment of the invention, the extender includes an elongated member having a first end portion secured to a contact member, and an opposite second end portion secured to an attachment member. The term "available touch plate surface area" is defined herein. The contact surface area of the contact member is greater than the predetermined available touch plate surface area of the key. Displacing the contact member of an extender attached to a key in a predetermined direction, e.g., downward direction displacing the key in the downward direction. The keyboard is selected from at least one of the following: a musical instrument keyboard, a computer keyboard, a calculator keyboard, a typewriter keyboard, and a telephone keyboard. In the discussion of non-limiting embodiments of the invention, the keyboard is a piano keyboard.

In other non-limiting embodiments of the invention, the contact member and the attachment member are secured to the first and second end portions, respectively, of the elongated member by a fastener selected from one of the following groups: adhesives, flowed molten metal or metal alloy, and mechanical fasteners. The elongated member can be an elongated metal rod preferably having a yield strength in the range of 10,000 to 50,000 pounds per square inch.

The attachment member can be selected from at least one of the following:

(a) a clip having a first leg and a second leg joined to a base to have a generally U-shaped cross section with the first and second legs biased toward one another, and a lever mounted to each leg wherein moving the levers toward one another increases the space between the legs;

(b) a clip having a first plate and a second plate, each plate having a first end portion and an opposite second end portion; a shaft is between the first and second end portions of the first and second plates; and a biasing member acts on the plates to bias the first end portions of the plates toward one another and the second end portions away from one another;

(c) a suction cup; and (d) a passageway in the key sized to receive an insert secured to the second end portion of the elongated member or to receive the second end portion of the elongated member.

In a further embodiment of the invention, the contact member and the attachment member may be detachably secured to the first and second end portions, respectively, of the elongated member, e.g., by providing a first part of a first securing arrangement on the first end portion of the elongated member and a second part of the first securing arrangement on the contact member and a first part of a second securing arrangement on the second end portion of the elongated member and a second part of the second securing arrangement on the attachment member. The securing or fastening arrangements may include at least one of the following:

(a) at least one end portion of the elongated member has a threaded surface and the attachment member and/or contact member has at least one bolt;

(b) the attachment member and/or contact member has a shaft having an internally threaded end portion or the elongated member has at least one internally threaded end portion, and at least one end portion of the elongated member has external threads or the attachment member and/or contact member has a shaft having external threads, respectively;

(c) the attachment member and/or contact member has a hollow shaft having an L-shaped groove and at least one end portion of the attachment member has a tab on the outer surface slidable within the L-shaped groove or at least one end portion of the elongated member has a hollow end portion having an L-shaped groove and the attachment member and/or contact member has a shaft having a tab slidable in the L-shaped groove; or (d) at least one end portion of the elongated member has a loop and the loop is secured to the attachment member and/or contact member by a fastener having a shaft and an enlarged end.

In further non-limiting embodiments of the invention, the contact member is a circular disk, the elongated member is a manually deformable elongated metal rod, and the attachment member is a binder clip.

Further, the invention relates to a piano keyboard having a plurality of keys wherein selected ones of the piano keys have a piano key extender. The piano key extender includes an elongated member, e.g., a deformable rod having a first end portion secured to a contact member, and an opposite second end portion secured to an attachment member. The attachment member is secured to selected ones of the piano keys wherein displacing the contact member in a downward direction displaces its respective piano key in the downward direction.

Still further, the invention relates to a method of depressing two or more piano keys. The method includes, among other things, the steps of providing at least two key extenders, the key extenders including a deformable rod having a first end portion secured to a contact member. The rod is shaped such that upon attaching it to its respective key, the contact members are adjacent to and spaced from one another. A user selectively depresses one of the contact members to depress a corresponding key.

Having the contact area of the contact member greater than the available touch plate surface area of the key allows a disabled person to depress a key by depressing the contact member, thereby avoiding depressing or contacting adjacent keys.

DETAILED DESCRIPTION OF THE PREFERRED EMBODIMENTS

Figure 1:
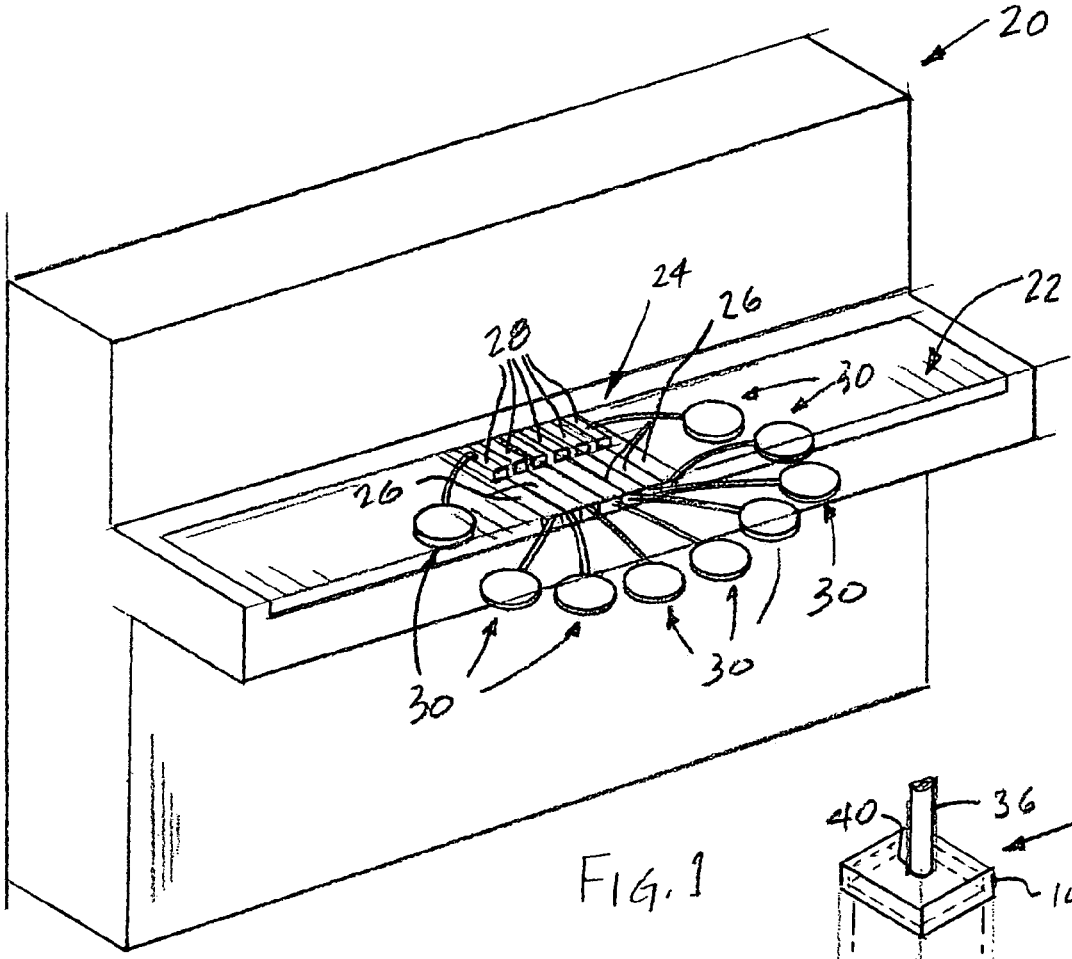
FIG. 1 is an orthogonal view of an upright piano showing only keys for one octave and having extenders according to the invention attached to selected white and black keys of the piano keyboard.

The invention will be described for use with keys of a musical keyboard and, in particular, with the keys of a piano keyboard. As will be appreciated, the invention is not limited thereto and can be used with the keyboard of other musical instruments, e.g., but not limiting the invention thereto, organs, and the keyboard of machines and devices, e.g., but not limiting the invention thereto, typewriters, telephones, computers, and calculators. Further, in the following discussion, the piano has only one keyboard; however, as will be appreciated, the invention is not limited thereto and can be practiced on pianos or organs having multi-deck keyboards.

In the following discussion and in the claims, the term "available touch plate surface area" means the area of the key provided for contact by the finger, e.g., but not limiting the invention thereto, the area of the keys of musical instruments, e.g., the black keys, and of typewriters, telephones, computer keyboards, and calculators. The "available touch plate surface area" for white piano keys is the area of the touch plate surface of white keys available for contact. The white keys of a musical keyboard have a portion of the touch plate surface in front of the black keys and a portion of the touch plate surface between the black keys. The portion of a white piano key in front of the black piano keys is the "available touch plate surface area" when referring to a white key of a musical instrument keyboard.

As used herein, spatial or directional terms, such as "inner", "outer", "left", "right", "up", "down", "horizontal", "vertical", and the like, relate to the invention as it is shown in the drawing figures. However, it is to be understood that the invention can assume various alternative orientations and, accordingly, such terms are not to be considered as limiting. Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g., 1 to 6.3, and ending with a maximum value of 10 or less, e.g., 5.5 to 10, and all subranges in between, e.g., 2.7 or 6.1.

Shown in FIG. 1 is an upright piano 20 having a keyboard 22 having an assemblage or musical octave 24 of white keys 26 and black keys 28, and an attachment or extender 30 incorporating features of the invention attached to the white keys 26 and outer ones of the black keys 28 of the assemblage 24. As can be appreciated by those skilled in the art, the keyboard of a piano has more than one octave and usually has about 8½ octaves. Only one assemblage or octave is shown in FIG. 1 for ease of discussion. Therefore, the following discussion relating to the white and black keys of the assemblage 24 is applicable unless indicated otherwise to any white and/or black key of the assemblage 24 shown in FIG. 1 and the assemblages of the keyboard understood to be present and not shown in FIG. 1. Further, in FIG. 1, the extender 30 is shown attached to all of the white keys 26 and the outer black keys 28. As can be appreciated, the extender 30 can be attached to all of the white and black keys or less than all of the white and/or black keys.

Figure 2:
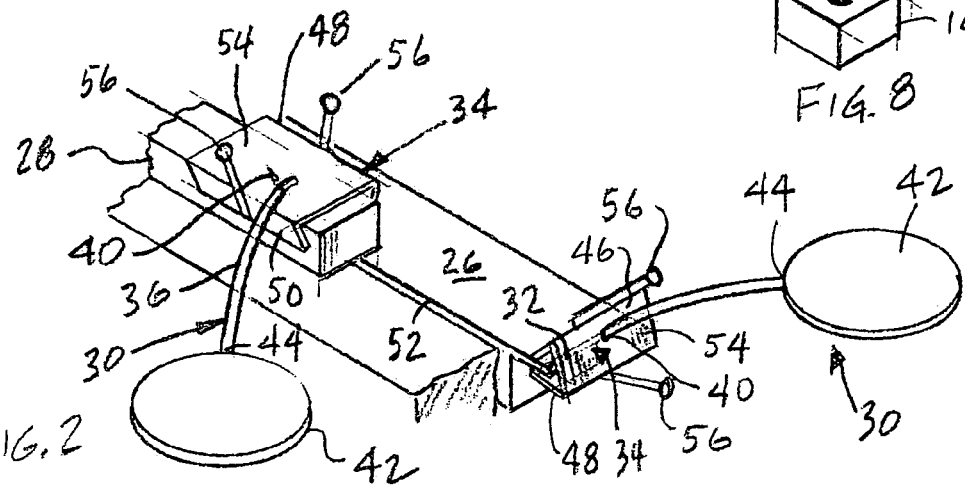
FIG. 2 is an orthogonal view of a black and white key of the piano shown in FIG. 1 having an extender according to the invention attached to each of the black and white keys.

In reference to FIG. 2, the extender 30 is shown mounted on flange 32 of the white key 26 and on the black key 28. The extender 30 includes an attachment member 34 to secure the extender 30 to the black key 28 and the flange 32 of the white key 26, and an elongated rod 36 having end portion 40 connected to the attachment member 34 in a manner discussed below. A disc 42 is connected to the opposite end portion 44 of the rod 36 in a manner discussed below.

The design of the attachment member 34 is not limiting to the invention, but preferably has a design and configuration to removably engage the keys. In FIG. 2, the attachment member 34 is a clip 48 having a pair of legs 50 and 52 connected to a base 54. The base and legs of the clip 48 are formed from one piece of spring steel and have the legs 50 and 52 biased toward one another. A lever or handle 56 mounted to the outer surface of each of the legs 50 and 52 is urged toward the other lever to increase the space between the ends of the legs 50 and 52. The clip 48 may then be positioned over the body of the keys, e.g., as shown for the black key 28 or over the flange of the key, e.g., as shown for the white key 26. The clip 48 is similar to a binder clip, e.g., of the type sold by ACCO Brands, Inc. under the registered trademark ACCO®.

As can be appreciated, the invention is not limited to the design of the attachment member 34. In the practice of the invention, it is preferred that the attachment member 34 be detachably secured to the keys 26 and 28 of the keyboard 22. In this manner, the extender 30 can be attached to the keys 26 and 28 as needed, making the piano useable by abled and disabled persons. In the following discussion, non-limiting embodiments of attachment members are present. As can be appreciated, the invention is not limited thereto and the following types of attachment members are present for purposes of illustration and not limitation.

Figure 3:
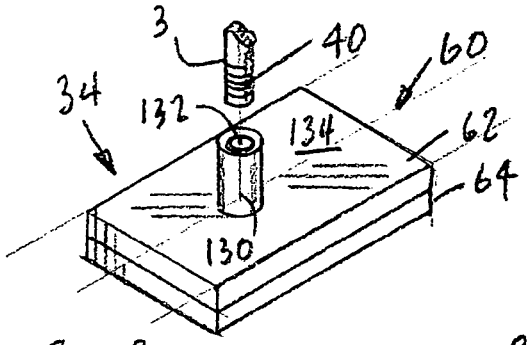
FIG. 3 is an orthogonal view of an attachment member to secure the extender to a piano key of the keyboard.

With reference to FIG. 3, the attachment member 34 is a plate arrangement designated by the number 60. The plate arrangement 60 includes a plate member 62 and a securing layer 64 to secure the plate member 62 to the keys, e.g., the contact surface area of the keys. The layer 64 may be any type of adhesive to securely bond the plate member 62 to a key, e.g., but not limiting the invention thereto, adhesives of the type sold by MACCO of Cleveland Liquid Nails™ or to detachably secure the plate member 62 to a key, e.g., but not limiting the invention thereto, an adhesive of the type used on paper sold by 3M Corporation under the registered trademark Post-It Notes®. In another non-limiting embodiment of the invention, the layer 64 may be a suction member to secure the plate member 62 to the keys.

Figure 4:
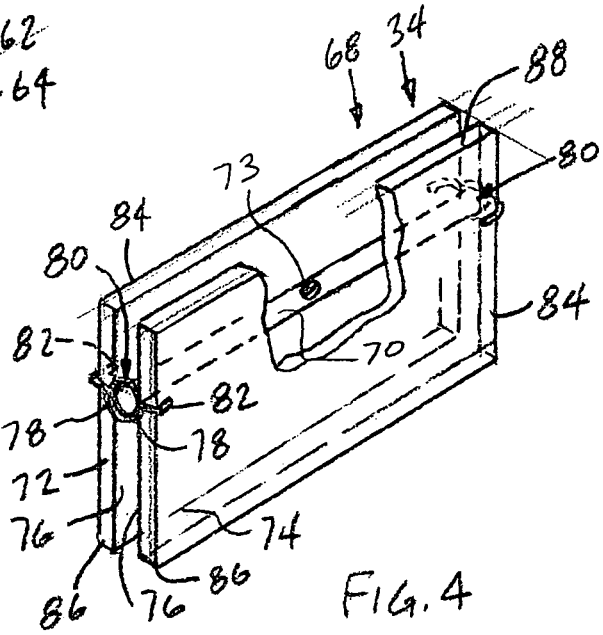
FIG. 4 is an orthogonal view of another embodiment of an attachment member of the invention to secure the extender to a piano key of the keyboard.

In a further non-limiting embodiment of the invention, the attachment member 34 shown in FIG. 4 is a clip arrangement 68 having a shaft 70 between a pair of plates 72 and 74. The inside surface 76 of each of the plates 72 and 74 has a groove 78 to secure the shaft 70 in position between the plates 72 and 74 and a spring 80 mounted on opposed ends of the shaft 70. The spring 80 has extenders 82 that engage the outer surface 84 of the plates 72 and 74 and bias lower end portions 86 of the plates 72 and 74 toward one another. Urging upper end portions 88 of the plates 72 and 74 toward one another increases the distance between the lower end portions 86 of the plates 72 and 74. The plates 72 and 74 of the clip arrangement 68 can be sized to fit between the keys without causing drag on the movement of the keys. Clip arrangements 68 on adjacent keys can be offset from one another, e.g., spaced different distances from the end of the keys to prevent overlapping of the plates 72 and 74 of adjacent clip arrangements 68. As can be appreciated, the lower end portions 86 of the plates 72 and 74 of the clip arrangement 68 can be biased away from one another by leaf springs, coil springs, or washer springs. Further, a non-limiting embodiment of the invention contemplates the use of a threaded shaft passing through the upper portion of the plates to move the lower end portions of the plates 72 and 74 toward and away from one another. An elongated member can be threadingly engaged in bore 73.

Figure 5:
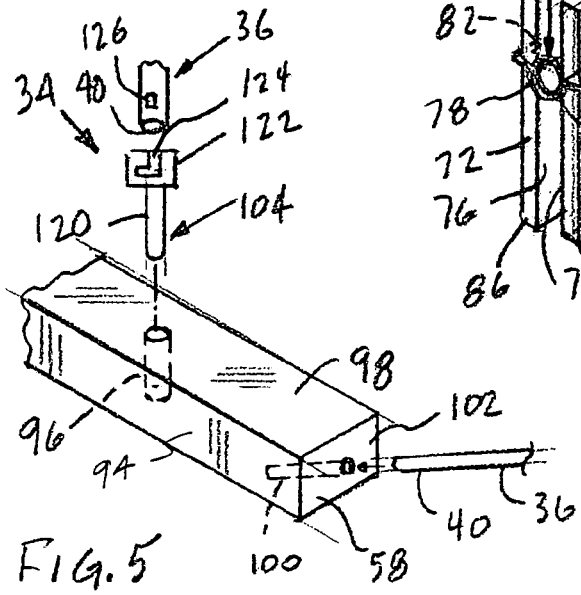
FIG. 5 is an orthogonal view of a key of a piano keyboard showing other attachment members of the invention to secure the extender to the key of the keyboard.
Figure 6:
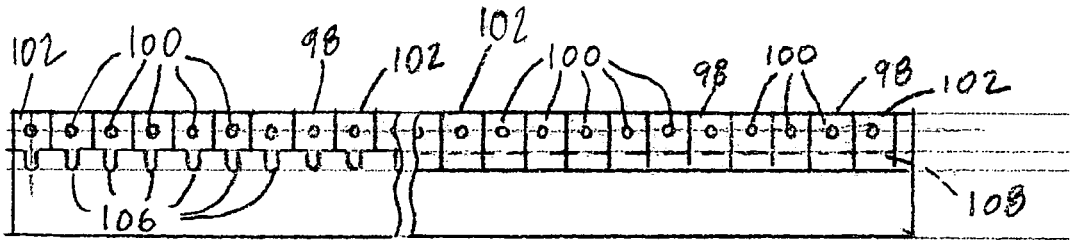
FIG. 6 is a front elevated partial view of a right and left half of a piano frame having portions removed to depress the keys using extenders incorporating features of the invention.

With reference to FIG. 5, there is shown a still further non-limiting embodiment of attaching the end portion of the rod 36 to a piano key. Shown in FIG. 5 is key 94, which can be a black key or a white key of a musical keyboard. The key 94 has a passageway 96 starting at the touch plate surface 98 of the key 94 and extending into the body of the key and/or a passageway 100 starting at front end 102 of the key extending into the body of the key. The passageways 96 and 100 can be sized to receive insert 104, or the end portion 40 of the rod 36. In the practice of the invention, it is preferred to use the insert 104 because the internal size of the passageway in the key can usually be made smaller to receive a structurally stable insert than the end portion 40 of the rod 36. Further, in the practice of the invention, the passageway 100 preferably slopes downward to prevent the insert 104 or end portion 40 of the rod 36 from falling out of the passageway. With reference to FIG. 6, in the event the insertion of the insert 104 or end portion 40 of the elongated rod 36 into the passageway 100 in the front end 102 of the key 94 prevents the key from being depressed, grooves 106 can be cut into the front board of the piano as shown in the left portion of FIG. 6, or a portion 108 of the front board of the piano may be cut out as shown in the right portion of FIG. 6.

Figure 7:
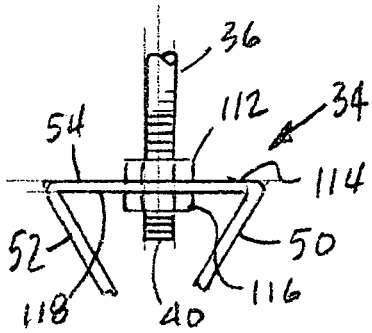
FIG. 7 is a front elevated partial view of a clip showing the attachment of an end portion of the elongated rod of the extender to the clip.

The end portion 40 of the elongated rod 36 can be secured to the attachment member 34 in any convenient manner, e.g., but not limited to the invention, by an adhesive, flowed molten metal or metal alloy, e.g., solder or mechanical fastening, e.g., releasable securing arrangements or locking facilities. In the practice of the invention, it is preferred to connect the end portion 40 of the rod 36 to the attachment member 34 with releasable securing arrangements or locking facilities. In this manner, any one of the various types of attachment members 34 can be used to secure the extender 30 to a key of the keyboard. With reference to FIG. 7, the end portion 40 of the elongated rod 36 may have threads 110 which are threaded into and through bolt 112 on outer surface 114, and bolt 116 on inner surface 118 of the base 54 of the clip 48 to secure the end of the rod 36 to the clip 48. With reference to FIG. 5, the insert 104 has a shaft 120 that is sized to fit into the passageway 96 and an open ended collar 122 having an L-shaped groove 124 in the wall of the collar 122. The end portion 40 of the elongated rod 36 has a tab 126 that slides into the long leg of the groove 124 after which the elongated rod 36 is rotated to move the tab 126 into the short leg of the L-shaped member 124 to capture the end portion 40 of the elongated rod 36 in the collar 122.

With reference to FIG. 3, a shaft 130 having an internally threaded end 132 is securely mounted on surface 134 of the plate 62. The end portion 40 of the elongated rod 36 has threads for detachably securing the end portion 40 of the elongated rod 36 to the end 132 of the shaft 130. Alternatively, the end portion 40 of the elongated rod 36 may be bent to form a loop, and a screw or rivet may be passed through the loop into the attachment member and/or the contact member to secure the end portion 40 of the elongated rod 36 thereto. As can be appreciated, the securing techniques discussed above are interchangeable, e.g., but not limiting to the invention, the internal walls of the passageways 96 and 100 can be threaded to receive threaded end portion 40 of the elongated rod 36, the detachable securing arrangements may be interchanged and used with any of the different attachment members, e.g., attachment members 34, 60, and 68. Further, any type of securing techniques may be used to secure or detachably secure the end portion 40 of the elongated rod 36 to the attachment member 34.

The elongated rod 36 may be made of any material that transmits force applied to one end portion of the rod to the other end portion, e.g., moving one end of the rod in a downward direction moves the body and the opposite end portion of the rod in a downward direction. In one non-limiting embodiment of the invention, the elongated rod is a pre-shaped rigid plastic, wooden, or metal rod. In this instance, the rod has a predetermined shape. In the practice of the invention, but not limiting the invention thereto, a metal wire having tensile yield strength of about 30,000 to 50,000 pounds per square inch ("PSI") can be shaped with shaping tools or preshaped during forming. In another non-limiting embodiment of the invention, the elongated rod 36 has sufficient flexure that it can be shaped manually and maintain its shape when supported at one end and extended in a horizontal position. Although not limiting to the invention, metal wires having a yield strength between 10000 to less than 30,000 PSI and preferably between 15,000 to 25,000 PSI can be used as flexible rods in the practice of the invention. As can be appreciated, as the length of the elongated wire increases the amount of force required to bend the elongated member between its end portions decreases. As can be appreciated, the invention is not limited to the length of the elongated member; however, to provide a distance from the keyboard, the elongated member should be at least six inches in length. Further, as the cross-sectional area of the wire increases, the force required to bend the wire between its endpoints increases. As can be appreciated, for manually bending the elongated member or wire as the yield strength increases, the cross-sectional area preferably decreases. Therefore, in selecting the elongated rod, the length and the cross-sectional area and the yield strength of the wire are to be considered. Another factor that is to be considered is the weight of the extender 30. The weight should not be greater than the force as required to move the key to its initial position or play position after the key has been depressed. In the practice of the invention, a carbon steel coat hanger wire having a length of about 12 inches and a diameter of about 1/16 inch was used to transmit a downward force applied to the disc 42 to the key of a piano keyboard.

The disc 42 can be made of any rigid material having any shape, e.g., circular, elliptical, square, or rectangular. The discs can all have the same shape or different shape to accommodate the discs at a position spaced from the keyboard. Preferably, in the practice of the invention, the disc is made of a rigid material, e.g., wood, metal, glass, plastic, or reinforced fiberglass. The area of the disc should be greater than the available touch plate surface area of the key. The end portion 40 the elongated rod 36 may be attached to the disc 42 using any of the techniques used to attach the end portion 40 of the elongated rod 36 to the attachment member.

In the practice of the invention, several extenders 30 were made and used to depress the keys of a piano having flanges 32. The disc of the extender was a 2½ inch plastic cover from a tobacco can. A loop was formed in an end portion of a portion of a coat hanger wire and a blind rivet passed through the center portion of the disc and the loop to secure the end portion of the coat hanger to the disc. The opposite end portion of the coat hanger was secured to a lever of a binder clip, by solder or by bending a loop in the wire, mounting a washer on the lever of the binder clip and passing a rivet through the loop lever and washer.

In the practice of the invention, having the contact area of the contact member, e.g., disc, greater than the available touch plate surface area of the key allows a disabled person to decrease a piano key by depressing the disc, thereby avoiding depressing or contacting adjacent piano keys. The contact surface of the discs can be colored for ease of identifying the note of the key, or can have a design to make the discs aesthetically pleasing.

Figure 8:
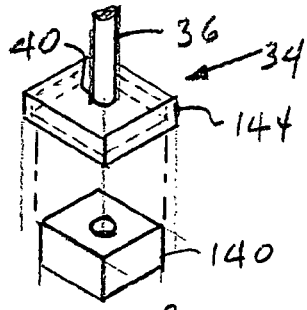
FIG. 8 is an orthogonal view of a key of a typewriter keyboard, computer keyboard, calculator keyboard, or a telephone keyboard and an attachment clip to secure the extender to the key.

With reference to FIG. 8, there is shown a key 140 of a computer keyboard, typewriter, telephone, or calculator. Attachment member 34 is a rigid cover 144 that fits over the key 140 and is attached to the end portion 40 of the elongated rod 36. The internal surface of the cover may have a tacky material to secure the cover on the key 140.

As can now be appreciated, the invention is not limited to the above non-limited embodiments of the invention and other embodiments within the scope of the function and cooperation of the elements can be assembled. Further, as can be appreciated, the particular embodiments described in detail herein are illustrative only and are not limiting to the scope of the invention, which is to be given the full breadth of the appended claims and any and all equivalents thereof.

The invention claimed is:

1. An extender for a key of a keyboard, comprising:

an elongated member having a first end portion secured to a contact member, and an opposite second end portion secured to an attachment member, wherein with the attachment member secured to the key, displacing the contact member in a predetermined direction displaces the key in the predetermined direction, wherein the key has a touch plate area and the contact member has a contact area greater than the touch plate area of the key.

2. The extender according to claim 1, wherein the keyboard is selected from at least one of the following: a musical instrument keyboard, a computer keyboard, a calculator keyboard, a typewriter keyboard, and a telephone keyboard.

3. The extender according to claim 2, wherein the keyboard is a piano keyboard.

4. The extender according to claim 1, wherein the contact member is secured to the second end portion of the elongated member by a fastener selected from one of the following: adhesives, flowed molten metal or metal alloy and mechanical fasteners.

5. The extender according to claim 1, wherein the attachment member is secured to the first end portion of the elongated member by a fastener selected from one of the following: adhesives, flowed molten metal or metal alloy, and mechanical fasteners.

6. The extender according to claim 1, wherein the elongated member is an elongated rod having a yield strength in the range of 10,000 to 50,000 pounds per square inch.

7. The extender according to claim 1, wherein the attachment member is the second end portion of the elongated member.

8. The extender according to claim 1, wherein the attachment member is selected from at least one of the following groups:

(a) a clip having a first leg and a second leg joined to a base and having a generally U-shaped cross section with the first and second legs biased toward one another, and a lever mounted to each leg wherein moving the levers toward one another increases the space between the legs;

(b) a clip having a first plate and a second plate, each plate having a first end portion and an opposite second end portion and a shaft between the first and second end portions of the first and second plates, a biasing member acting on the plates to bias the first end portion of the plates toward one another and the second end portion away from one another; and (c) a suction cup.

9. The extender according to claim 1, wherein the attachment member comprises a passageway in the key sized to receive an insert secured to the first end portion of the elongated member or the second end portion of the elongated member.

10. The extender according to claim 9, wherein the key has a contact area lying in a generally horizontal plane and an end surface lying in a vertical plane and an opening of the passageway is at the end surface of the key and the passageway has a downward slope.

11. The extender according to claim 1, wherein the attachment member and the second end portion of the elongated member are detachably secured together by at least one of the following fastening arrangements:

(a) the second end portion of the elongated member has a threaded surface and the attachment member has at least one bolt;

(b) the attachment member has an internally threaded shaft or the elongated member has an internally threaded second end portion and the second end portion of the elongated member has external threads or the attachment member has a shaft having external threads;

(c) the attachment member has a hollow shaft having an L-shaped groove and the second end portion of the attachment member has a tab on the outer surface slidable within the L-shaped groove or the second end portion of the elongated member has a hollow end portion having an L-shaped groove and the attachment member has a shaft having a tab slidable in the L-shaped groove; and (d) the second end portion of the elongated member has a loop and the loop is secured to the attachment member by a fastener having a shaft and an enlarged end.

12. The extender according to claim 1, wherein the contact member and the second end portion of the elongated member are detachably secured together by at least one of the following fastening arrangements:

(a) the first end portion of the elongated member has a threaded surface and the contact member has at least one bolt;

(b) the contact member has an internally threaded shaft or the elongated member has an internally threaded first end portion and the first end portion of the elongated member has external threads and the contact member has a shaft having external threads;

(c) the contact member has a hollow shaft having an L-shaped groove and the first end portion of the elongated member has a tab on the outer surface slidable in the L-shaped groove or the first end portion of the elongated member has a hollow end portion having an L-shaped groove and the contact member has a shaft having a tab slidable in the L-shaped groove; and (d) the first end portion of the elongated member has a loop and the loop is secured to the contact member by a fastener having a shaft and an enlarged end.

13. The extender according to claim 1, wherein the elongated member is a manually deformable elongated metal rod; and the attachment member is a binder clip.

14. The extender according to claim 13, wherein the contact member is a circular disc, and the disk and binder clip are detachably secured to their respective end portion of the metal rod.

15. The extender according to claim 1, wherein the keyboard is a piano keyboard and the key is one of a plurality of piano keys and at least one of the piano keys has the attachment member secured thereto defined as the attached piano key, wherein displacing the contact member in a downward direction displaces the attached piano key in the downward direction.

16. The extender according to claim 15, wherein the elongated member is a deformable metal rod and the contact member is a disc having a circular contact area greater than the predetermined available touch plate surface area of the attached piano key.

17. The extender according to claim 16, wherein the attachment member is a clip, and the clip and the disc are each detachably secured to their respective end portion of the metal rod.

18. An extender for a key of a keyboard, comprising:

a deformable rod having a first end portion and an opposite second end portion, with a first part of a first securing arrangement on the first end portion of the rod and a first part of a second securing arrangement on the second end portion of the rod;

a contact member having a second part of the first securing arrangement with the first and second parts of the first securing arrangement joined together; and an attachment member having a second part of the second securing arrangement with the first and second parts of the second securing arrangement joined together.

19. A method of depressing keys on a musical instrument, comprising the steps of:

providing at least two key extenders, each having an elongated member and a contact member positioned at one end of the elongated member;

shaping at least one of the elongated members such that upon attachment of the elongated member to a key the contact members are adjacent to and spaced from one another;

attaching the elongated members to selected ones of the keys; and depressing the contact members to depress corresponding keys.

* * * * *